US006698495B2

(12) United States Patent
Rusch

(10) Patent No.: US 6,698,495 B2
(45) Date of Patent: Mar. 2, 2004

(54) OIL BETWEEN AIR ROTATIONAL DRIVE SYSTEM WITH END OF CYCLE IMPACT CUSHION

(76) Inventor: Dale Otto Rusch, 320 W. 8th St., Washburn, WI (US) 54891

( * ) Notice: Subject to any disclaimer, the term of this patent is extended or adjusted under 35 U.S.C. 154(b) by 0 days.

(21) Appl. No.: 10/153,584

(22) Filed: May 22, 2002

(65) Prior Publication Data

US 2003/0217832 A1 Nov. 27, 2003

(51) Int. Cl.[7] ..... B22C 13/08
(52) U.S. Cl. ..... 164/165; 164/166; 164/412
(58) Field of Search ..... 164/165, 166, 164/19, 20, 21, 412

(56) References Cited

U.S. PATENT DOCUMENTS 4,381,857 A * 5/1983 Cook ..... 267/64.15
5,785,345 A * 7/1998 Barlas et al. ..... 280/124.165
5,971,838 A * 10/1999 Watkins ..... 451/434

* cited by examiner

*Primary Examiner*—Kuang Y. Lin

(57) ABSTRACT

A rotary drive system is provided that can rotate any object or a die holding assembly up to 270 degrees of rotation that uses both air and oil along with a oil/air pressure transferring device to smooth out each rotary cycle. The rotary drive system also utilizes a combination of air and oil in combination with a flow control device and an oil recovery reservoir to provide an impact cushion at the end of each rotational cycle.

11 Claims, 2 Drawing Sheets

OIL BETWEEN AIR ROTATIONAL DRIVE SYSTEM WITH END OF CYCLE IMPACT CUSHION

BACKGROUND OF THE INVENTION

In the metal foundry business there is a need for cores that can be placed in the molds which produce voids in the castings as the molten metal is poured into molds. The cores generally are made from a sand and resin mixture that is forced into heated dies. The heat causes the sand-resin mixture to solidify producing the core. Dr. Johan Croning developed the phenolic resin process during WWII in Germany. The Germans gravity fed and hand rammed the resin sand around heated plates and contoured dies to make mortar and artillery shells. The American government brought the process to the United States and promoted it in 1947.

In the 1950's Dependable foundry made its first machine to pneumatically inject phenolic resin, phenolic flake, and hexa catalyst into heated dies. Hence the first shell core machine was born.

Generally there are two types of cores; solid cores and shell cores which are hollow on the inside.

A variety of machines have been developed to manufacture these cores. In general cores are manufactured in a heated die that is held by a die holder. A sand resin mixture is forced into a fill opening while the fill opening is in an upward position.

When solid cores are made, the entire core hardens. After the core has a final cure, the die holder and die are opened up and the solid core is extracted. After the solid core is extracted, the die holder and die are closed and the cycle is repeated.

When shell cores are made, a sand resin mixture is forced into a fill opening while the fill opening is in an upward position. As the outer layer of resin-sand mixture cures or hardens to a die specified shape and utility thickness, the die holder carriage and die must be rotated so that the fill opening is in a downward position and the die holder is rocked back and forth so that any of the resin-sand that is unhardened will be shaken but of the die. This results in the formation of a hollow or shell core. After the uncured sand is shaken out the die, the die is rotated so that the fill opening is in a 90 degree position (facing the operator). After the core has a final cure, the die holder and die are opened up and the shell core is extracted. After the core is extracted the die holder and die are closed and the cycle is repeated.

There are several different designs of core machines and shell core machines. There are also several methods used to rotate and shake the die holder and die. One design requires the rotating of the die holder carriage and die manually by hand. A second design uses cylinders and pneumatic power to rotate the die holder carriage and die. A third design uses cylinders and hydraulic power to rotate the die holder carriage and die. A fourth design uses an electric motor along with a gear reducer and roller chain to rotate the die holder and die.

The most productive shell core machine has been the pneumatic powered machine. This machine however, has been very problematic. The machine is constantly in need of adjustment.

These machines can produce a wide range of sizes and shapes of shell cores by using different dies in the die holder. Dies for different cores can vary from a few pounds to hundreds of pounds. Sand demand for cores can vary from a few ounces to tens of pounds. Every time a different die is placed into the die holder to make a different part, a lengthy process of changing flow controls and cams and limit switches is required to provide the optimum cycle for producing each different shell core design.

During each short core making cycle the drive system must rotate the heavy die holder carriage, dies, and sand hopper. Because some of the individual components in the drive system are poorly designed, the stresses and strains and impact and inertia changes resulting from rotating the heavy die holder, dies, and sand hopper causes the various components to fail. This results in expensive repairs and much unproductive down time.

Another problem with the pneumatic drive system is that the rotational cycle usually has a jerky motion and does not rotate at a constant high rate of travel through each production cycle.

Another problem with the pneumatic drive system is that the rotational cycle of 270 degrees has a 180 degree portion and a 90 degree portion. The 180 degree portion is where the die front rotates from "top dead center to bottom dead center" or from zero degrees to 180 degrees. The 90 degree rotation is when the die front rotates from facing the operator at a horizontal to a bottom dead center position. (90 degrees to 180 degrees. The inertia of the 180 degree rotation is greater than the inertia of the 90 degree rotation. The machine can be set for smooth rotation in only one of the rotational portions. In other words, if the machine is set for smooth rotation in the 90 degree portion it will not have smooth rotation in the 180 degree portion and vise versa. The operation manual even states that machine "cannot be properly set for both conditions!"

Another problem with the prior art drive system is that at both ends of each 270 degree cycle the drive piston hits the inside end of the piston drive cylinder to bring the heavy die holder carriage assembly to the ending position. Because of the repeated heavy impact between the piston and cylinder at the end of each cycle the drive piston and/or drive cylinder fail often.

SUMMARY AND OBJECTS OF THE INVENTION

It is a primary object of the invention to provide an improved drive system for a shell core machine that overcomes the above problems of the existing prior art.

It is another object of the invention to provide a drive system that is more rugged and more dependable than the existing prior art drive systems.

It is another object of the invention to provide a drive system design that spreads out the stresses and strains and loading and inertia and torsional forces that are the result of rotating the die holder, die, and sand hopper during each core making cycle.

It is another object of the invention to provide a drive system design that uses more than one drive cylinder and piston along with a double ended lever with a drive shaft in a lever center location. This provides a more evenly applied force across all drive components and allows for a greater applied pressure.

It is another object of the invention to provide a drive system that rotates at a consistent high rate of travel, smoothly, through each production cycle rather than the, jerky motion of the prior art drive system.

It is another object of the invention to provide a drive system that uses both air and oil along with a oil/air pressure transducing device or a oil/air pressure transferring device. This smooths out each production cycle. Thus, the jerky motion of the prior art drive system is eliminated.

It is another object of the invention to provide a drive system that provides a cushion at the end of each 270 degree rotation cycle. This minimizes the impact of the drive piston hitting the end of the piston drive cylinder.

It is another object of the invention to provide a drive system that utilizes a combination of air and oil in combination with a metered port or a restricting orifice and check valve to provide a cushion at the end of each piston stroke. This minimizes the impact of the drive piston hitting the end of the piston drive cylinder.

It is another object of the invention to provide a drive system that provides an end of cycle cushion that is adjustable.

It is another object of the invention to provide a drive system with a cushion at the end of each 270 degree rotation cycle that has a long service life.

It is another object of the invention to provide a drive system that provides a more rapid index of die carriage holder and die from start position to blow fill position. This can be up to 50% faster.

It is another object of the invention to provide a drive system that requires very little or no adjustment to compensate for different sizes and weights of different dies that are used to make different cores in the shell core machine.

It is another object of the invention to provide a drive system that requires very little or no adjustment so that there is a smooth rotation through the entire 270 degree rotation; both in clockwise rotations and counterclockwise rotations.

The objects and advantages of the invention will become apparent when the drawings are studied in conjunction with reading the following description.

DESCRIPTION OF THE PRIOR ART DRIVE SYSTEM

Figure 1:
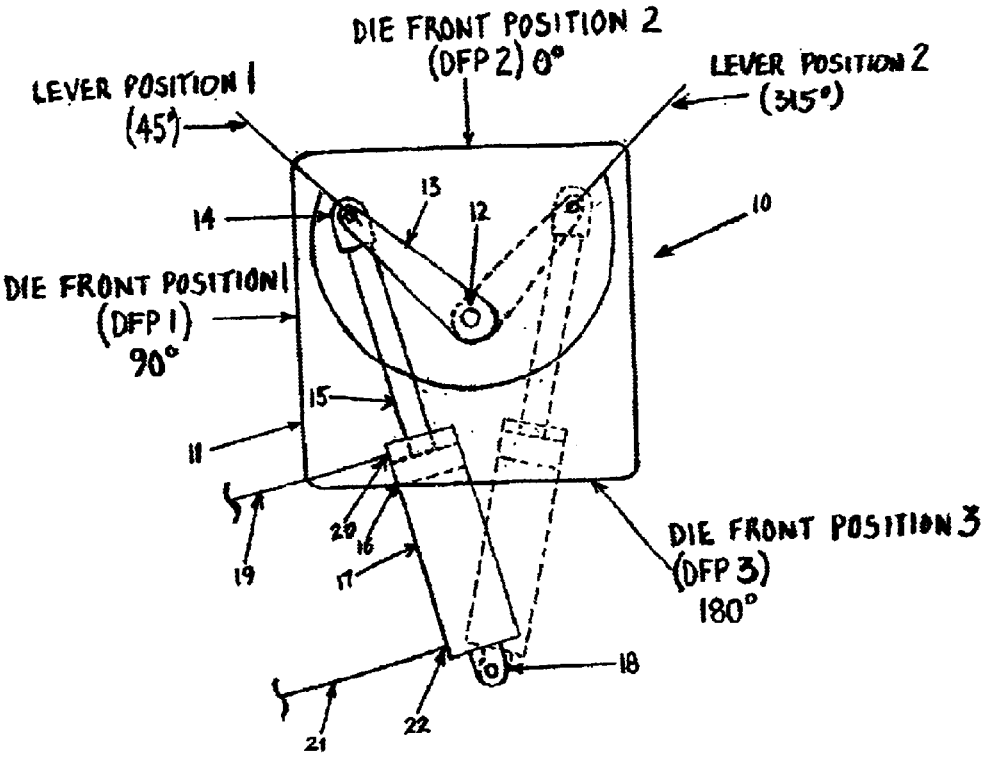
FIG. 1 is a drawing of the drive system of the existing prior art. This drive uses a single pneumatically powered drive cylinder and piston which is attached to a lever which is attached to a shaft which is connected to the die holder carriage, die and sand hopper.

Referring now to the drawings, the existing prior art drive system 10 is shown in FIG. 1. Die holder 11 and enclosed die have a Die Front Position 1 (DFP1) which is the starting, and ending position of every core making cycle. The die front position faces the operator at a 90 degree position from the top of the machine. A shaft 12 is connected to the die holder. Lever 13 connects the shaft to pivot coupling connection on drive shaft 15. Seals 16 on drive piston make a tight fit between drive shaft and drive cylinder 17. Pivot connection 18 of drive shaft allows movement through each core making cycle. Air line 19 is attached to drive cylinder at top connection 20. Air line 21 is attached to drive cylinder at bottom connection 22.

At the beginning of a typical core making cycle the die front is facing the operator at a 90 degree angle from the top of the machine or "die front position 1" (DFP1). During a typical cycle the operator presses the start switch and air is forced into the top of the drive cylinder 17 which starts the die holder 11 rotating in a counterclockwise movement. The drive shaft 12 pulls the lever 13, rotates shaft 12, and the attached die holder 11 down to the 180 degree position. The control system then switches the control valve and air is forced into air line 21 at the bottom of the drive cylinder. This forces the continuation of the counterclockwise rotation a full 270 degrees so that the die front is at 0 degrees, or top dead center. The rotation of die holder assembly comes to the end of 270 degree rotation when the drive piston 15 hits the end of the drive cylinder 17. This is "die front Position 2" (DFP2). At this point the sand/resin mixture is forced into the heated die cavity by compressed air (blow). The heated die causes the outer layer of the sand/resin mixture to harden (invest) and then the die holder assembly is rotated in a clockwise direction so that the die front is at bottom dead center, or 180 degrees. This is "die front position 3" (DFP3). In this position the control system causes the drive system to rock the die holder back and forth (rock drain.) This drains any unhardened sand from the center of the core, thereby producing a hollow core, or "shell core." After a final cure period, the drive system continues the clockwise rotation of the die holder assembly into the ending/starting position. (DFP1) The rotation of die holder assembly comes to the end of 270 degree clockwise rotation when the drive piston 15 hits the end of the drive cylinder 17. The die holder is unlatched (unlatch), the die is opened, and the core is extracted from the die. The die is closed and the cycle starts again.

As can be seen in the drawing the lever rotates through a 270 degree arc starting at 45 degrees and ending at 315 degrees.

This drive uses a single pneumatically powered drive cylinder and piston which is attached to a lever which is attached to a shaft which is connected to the die holder. The problems with this drive system have been described heretofore.

DESCRIPTION OF THE PREFERRED EMBODIMENTS

Figure 2:
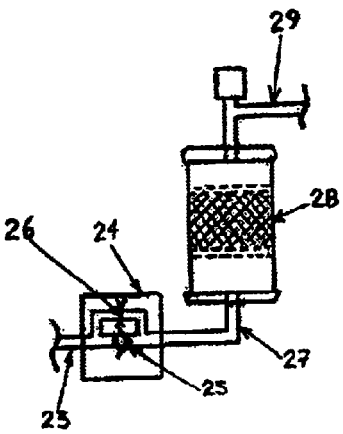
FIG. 2 is one of the components of the invention which essentially is an end of cycle impact cushion device. This drawing shows the oil recovery reservoir empty.

FIG. 2 is a mechanical and schematic layout of one of the embodiments of the present invention. This device provides an end of cycle cushion effect for the drive system. If this device were to be used on a prior art drive system such as shown in FIG. 1, oil/air line 23 would connect to upper drive cylinder 17 through air line 19. Other components in this device include flow control device 24 which includes check valve 25 which allows free flow of air and oil into the top drive cylinder 17 and check valve 25 does not allow oil and air to flow freely through it in the opposite direction. When air and oil are being forced out of the top of drive cylinder 17, it would enter air line 19 & 24 and passes through flow restricting device 26. Flow restricting device could be a restrictive orifice or a metered port or any device that restricts fluid flow. Oil/air line 27 connects into the bottom of oil recovery reservoir 28. Air line 29 connects from the oil reservoir to a machine control valve (not shown). This end of cycle cushion device is explained in more detail further into the description of the preferred embodiments. This drawing shows the oil recovery reservoir empty.

Figure 3:
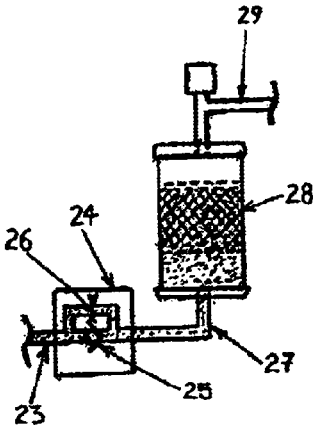
FIG. 3 is end of cycle impact cushion device showing the oil recovery reservoir full. The objects and advantages of the invention will become apparent when the drawings are studied in conjunction with reading the following description.

FIG. 3 is end of cycle impact cushion device showing the oil recovery reservoir full.

Figure 4:
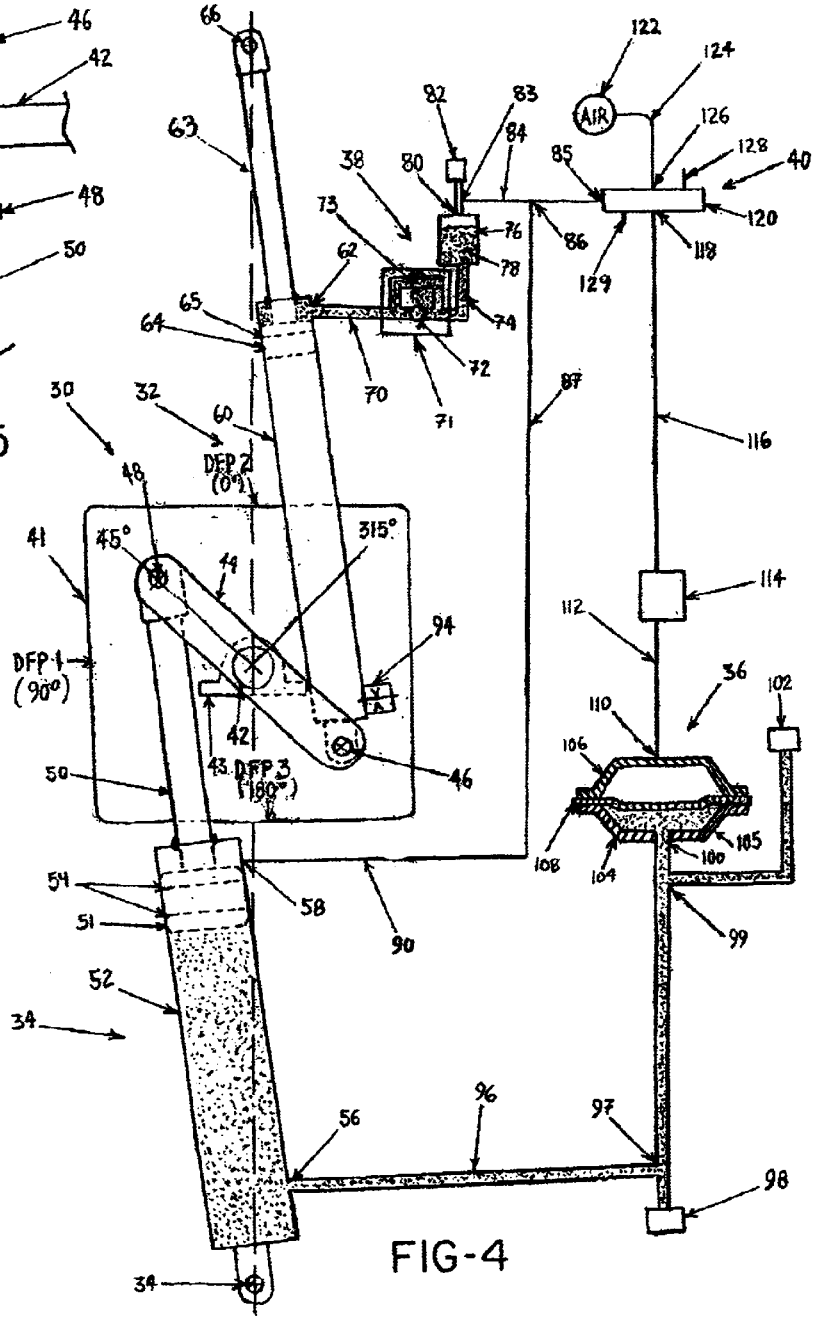
FIG. 4 is a mechanical and schematic layout of the present invention.

FIG. 4 is a mechanical and schematic layout of several embodiments of present invention. Generally at 30 is the die holder assembly connecting to a bearing supported hollow drive shaft and a double ended lever. Generally at 32 is a top drive rod, piston and cylinder, and generally at 34 is a bottom drive rod, piston and cylinder. Generally at 36 is a oil/air pressure transducer that has air on one side and oil on the other side. Generally at 38 is an oil reservoir and a check valve in combination with a restricting orifice and generally at 40 is a four way, three position control valve.

Die holder assembly 41 is connected to Shaft 42 which is fastened at the other end to double ended lever 44. Shaft 42 is held by bearing support 43. The die holder carriage assembly includes burner manifolds, a die holder, a die and a sand hopper which are together can weigh up to 900 pounds.

Figure 5:
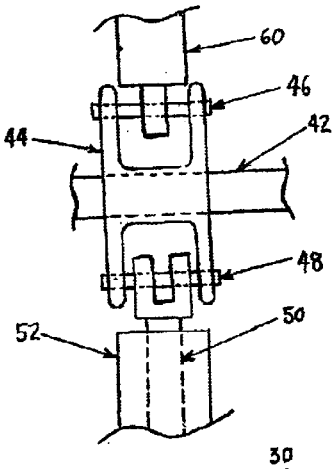
FIG. 5 is a front view of the double ended lever of present invention.

Double ended lever 44 is made from ductile iron to make it very rugged, and is connected at one end to pivot connection 46 between upper drive cylinder 60. Double ended lever 44 has an "H" shape as can be seen in FIG. 5. The other end of double lever is connected to pivot connection 48 of lower drive rod 50. Drive rod 50 has piston 51 and has seals 54 inside drive cylinder 52. Drive cylinder 52 has pivot connection 34 and 48. Lower cylinder has a lower oil line connection 56 and an upper air line connection 58.

Upper drive cylinder 60 has a lower flow control device 94 and an upper air/oil inlet/outlet connection 62. Upper drive, rod 63 and piston 64 has seals 65 and pivot connection 66 and 46.

Oil/air line 70 connects to upper drive cylinder 60 and has a flow control device 71 which allows free flow of air and oil into the top drive cylinder and restricted flow in the opposite direction. Flow control device includes check valve 72 and a flow restricting device 73. When air and oil are being forced out of the top of drive cylinder 60, it would enter air line and pass through restricting device 73. Flow restricting device 73 could be a restricting orifice or a metered port or any device that restricts fluid flow. Oil/air line 74 connects into the bottom of oil recovery reservoir 76. An oil deflector/diffuser 78 is located inside the oil recovery reservoir which helps retain the oil while allowing the air to exhaust. An oil reservoir/diffuser or accumulator could have a wide variety of designs. One way to provide a diffuser/accumulator inside a reservoir could be a copper mesh material. Oil fill line 80 terminates in an opening with a plug 82 which is in a normally closed configuration. Air line 84 connects from the oil reservoir to the machine control valve 120 at air connection 85.

Air line 87 makes a "T" connection 86 into air line 84. Alternately, air line 87 could connect directly into control valve 120. Air line 87 connects into air connection 58 of lower drive cylinder.

Upper cylinder has a restricting orifice 94. The restricting orifice produces a dampening effect in the drive system during a piston up-stroke (in cylinder vacuum) and a cylinder down-stroke (in cylinder compression).

Oil line 96 connects from the lower drive cylinder oil connection 56 and to the oil connection 100 of the oil side 104 of the oil/air pressure transducer 105. Oil line 96 has a "T" connection 97 which leads to an oil drain port and cap 98 which is in a normally closed position. Oil line 96 also has a "T" connection 99 which leads to an oil fill port and cap 102 which is in a normally closed position.

The oil/air pressure transducer 105 has an oil reservoir side 104 and an air reservoir side 106. Between the two sides of the oil/air pressure transducer is a rubber diaphragm 108 which stretches toward the oil side or the air side which ever side has a higher pressure. In this embodiment there is one pressure transducer, however, two or three, or more pressure transducers could be hooked up in parallel rather than using one, to assure enough volume of oil to drive cylinder piston through full cylinder stroke.

Additionally, other pressure transducing devices could be used also.

Air line connection 110 and air line 112 connect to pressure regulator 114 which regulates the input air pressure between 0 and 150 psi. Air line 116 connects the pressure regulator to an air fitting 118 on the machines 4 way 3 position control valve 120.

Compressed air supply line 122 is connected by air line 124 into an air fitting 126 on machine control valve 120. Machine control valve 120 has exhaust ports 128 and 129.

OPERATION

Die holder assembly 41 and enclosed die have a Die Front Position 1 (DFP1) which is the starting, and ending position of every core making cycle. The die front position faces the operator which is a 90 degree position in a counter clock wise direction with top dead center being zero degrees. At the beginning of a core making cycle the die is in a latched or closed position.

To start a core making cycle the operator presses the start switch which opens control valve 120 which allows air to be forced into air line 84 and into the top of oil reservoir/accumulator 76 which forces oil therein to flow through check valve 72 and then into the top rod side of piston of drive cylinder 60. Air and oil flowing into the top drive cylinder 60 causes drive piston 64 and rod 63 to retract which causes drive lever 44 and die holder assembly 41 to begin to rotate in a counterclockwise direction. At the same time air is forced into air lines 84, air is also being forced into air line 87 into air line 90 and then into the top of bottom drive cylinder 52. The air being forced into the top of the drive cylinder 52 also exerts a force on lever 44 which starts lever 44, shaft 42, and the die holder assembly 41 rotating in a counterclockwise movement.

In this preferred embodiment rather than having a single drive piston, there are two drive pistons and cylinders utilized with a double ended lever with the shaft 42 at central pivot position. This two cylinder design helps achieve equal force rod extend or rod retract. Additionally, the double ended lever with a fixed central pivot spreads out the stress and strains and resulting wear and tear of the components caused from rotating the heavy die holder assembly. The double ended lever is made from ductile iron which makes it very rugged as opposed to the steel lever of the prior art drive.

As the die holder assembly continues to rotate in the counter clockwise direction, air is forced out of the bottom of top drive cylinder 60 through restricting orifice 94 which provides a dampening effect.

Additionally, as the die holder assembly continues to rotate counterclockwise, oil is forced out of the bottom of bottom drive cylinder 52, through oil line 96 and into the oil side of air/oil pressure transducer. Rubber diaphragm 108 flexes toward the air side 106 of the device which provides a dampening and smoothing effect in the drive system. As oil is forced into the oil side 104 air/oil transducer, air is forced out of the air side 106 and into air lines 112 and 116 and through 4-way, 3-position control valve 120 and exhausted to ambient.

The drive system continues to rotate the die holder assembly in a counterclockwise direction until the drive cylinder rods are in a fully retracted position. At this point bottom drive shaft pivot 48 is at bottom dead center or 180 degrees. At this point the lever and cylinders are perfectly vertical. At this point the control system directs control valve 120 to switch positions and directs air into air line 116 through pressure regulator 114, into air line 112 and into the air side 106 of air/oil pressure transducer 105. As pressurized air enters the air side 106 of air/oil transducer 105 the diaphragm 108 is deflected in the opposite direction and oil is forced out of the oil side 104 and into oil line 96. Oil continues through oil line 96 and into the piston side of bottom drive cylinder 52. The oil entering drive cylinder 52 pushes the drive piston upward and causes the drive lever 44 and die holder assembly 41 to continue rotating in a counter clockwise direction. Oil continues to flow into lower drive cylinder 52 and continues the rotation. As the rotation nears the end of the full 270 degrees the die front is approaching the 0 degrees position, or "die front position 2" (DFP2).

As the die holder assembly 41 rotates in a counterclockwise rotation, air has been flowing out of the drive cylinder 60 and through restricting orifice 73 at a high flow rate. As the drive system nears the ending position of the 270 degree cycle, cylinder rod 63 is approaching the last few inches of drive cylinder 60, the few ounces of oil that are in the top of cylinder 60 begin to flow out of drive cylinder 60 and then into air/oil line. 70 and then the flowing oil hits restricting orifice 73. As the oil hits restricting orifice 73 the rate of oil flow is slowed dramatically compared to the rate of flow of air through the restricting orifice 73 because the oil has a higher viscosity than the air. Also air is compressible and liquids are not compressible. Flow rate of fluids traveling through the flow control device goes from rapid flow to moderate flow to slow flow as piston approaches the end of working stroke.

This cushion effect or shock absorbing effect causes the entire drive system and attached die holder assembly to slow down and minimizes the impact as the heavy die holder assembly moves into the end of cycle position. This innovative device effectively absorbs the forces caused by the rotational inertia and momentum of the 900 pound die holder assembly rotating through a 90 or 180 or 270 degree rotation in a few seconds.

As the oil continues to flow through the restricting orifice it is collected in oil recovery reservoir 76. A coil of copper mesh 78 is located inside the oil reservoir which diffuses and accumulates the oil while allowing the air to escape. Other devices that could be utilized other than copper mesh might include other metal meshes, stacked perforated plates, plastic beads, fiber sponge, or combinations thereof.

When the die front is at zero degrees or "die front Position 2" (DFP2), the sand/resin mixture is forced into the heated die cavity by compressed air (blow). Shortly thereafter, the heated die causes the outer layer of the sand/resin mixture to harden (invest).

Next, the control system and control valve switches position forcing air into air lines 84 and 87 into the tops of the two drive cylinders. This causes the die holder assembly 41 to begin rotating in a clockwise motion and continues to rotate until the die front is positioned downward or 180 degrees. This is "die front position 3" (DFP3). In this position the control system and control valve causes the drive system to rock the die holder back and forth (rock drain) which drains any unhardened sand from the center of the core. This produces the hollow core, or "shell core".

After a final cure period, the drive system rotates the die holder in a clockwise motion toward the starting position. (DFP1) This motion is accomplished as described earlier by the control valve directing air through airline 118 into the air side of oil/air pressure transducer thereby forcing oil out of the pressure transducer and into oil line 96 and into lower drive cylinder 52.

As the die holder assembly 41 rotates in a clockwise rotation air has been flowing out of the top drive cylinder and through restricting orifice 73 at a high flow rate. As the drive system nears the ending position of the clockwise cycle, drive piston 64 is approaching the end of drive cylinder 60, the few ounces of oil that are in the cylinder begin to flow out of drive cylinder 60, then into air/oil line 70, then to restricting orifice 73. As the oil hits restricting orifice 73 the rate of flow is slowed dramatically compared to the rate of flow of air through the restricting orifice because of the higher viscosity of the oil compared to the viscosity of the air. The flow rate of fluids traveling through the flow control device goes from rapid flow to moderate flow to slow flow as piston approaches the end of working stroke. This cushion effect or shock absorbing effect causes the entire drive system to slow down and minimizes the impact as the heavy die holder assembly moves into the start or end of cycle position. Again, this innovative device effectively absorbs the forces caused by the rotational inertia and momentum of the 900 pound die holder assembly near both ends of its 270 degree cycle which takes only a few seconds.

Similar to the other end of the 270 degree cycle, the oil continues to flow through the restricting orifice 73 and is collected in oil accumulator reservoir 76. Different designs for the oil reservoir/deflector could be utilized as long as they perform the same function.

Again, in the prior art drive system, cycle comes to an end when the drive piston hit the end of the drive cylinder. This repeated high impact is cause of the prior art drive cylinder to fail often.

To complete the core making cycle, the die holder is unlatched (unlatch), the die is opened, and the core is extracted form the die. The die is then closed and latched and the core making cycle starts again.

As can be seen in the drawing the double ended lever rotates through a 270 degree arc starting at 45 degrees and ending at 315 degrees.

This invention having been described in its presently contemplated best mode, it is clear that it is susceptible to numerous, variations, modifications, modes and embodiments within the ability of those skilled in the art and without departing from the true spirit and scope of the novel concepts or principles of this invention. It should be understood that this drive system could have widespread use in applications other than for manufacturing cores. Accordingly, the scope of the invention is defined by the scope of the following claims.

What is claimed is:

1. A rotational drive system that is capable of rotating an object in clockwise and/or counterclockwise directions up to two hundred seventy degrees of rotation; said rotational drive system having a dual piston drive and an oil between air drive component; said rotational drive system comprising:

an object that is to be rotated a double ended lever; said double ended lever having a central pivot and a first lever arm and a second lever arm; said first lever arm extending from said central pivot to a first lever arm tip; said first lever arm tip having a pivoting connection thereon; said second lever arm extending from said central pivot to a second lever arm tip; said second lever arm tip having a pivoting connection thereon;

a shaft having a first shaft end and a second shaft end; said first shaft end securely fastened to said object and said second shaft end securely fastened to said central pivot of said double ended lever;

a first drive piston and cylinder assembly having a first drive cylinder, a first drive piston and a first drive shaft; said first drive cylinder having a closed end; said closed end of said first drive cylinder having a pivoting connection thereon; said pivoting connection of said closed end of said first drive cylinder being connected to said pivoting connection of said end of said first lever arm; a flow restricting device located near said closed end of said first drive cylinder; said first drive cylinder having said first drive piston therein; said first drive shaft being connected on one end to said first drive piston; said first drive shaft having a shaft pivoting connection on the opposite end of said first drive shaft;

a control valve;

a first fluid line that is connected at one end near said shaft end of said first drive cylinder and connected at the other end to said control valve;

a second drive piston and cylinder assembly having a second drive cylinder, a second drive piston and a second drive shaft; said second drive cylinder having a closed end; said closed end of said second drive cylinder having a pivoting connection thereon; said second drive cylinder having said second drive piston therein; said second drive shaft being connected on one end to said second drive piston; said second drive shaft having a shaft pivoting connection on the opposite end of said second drive shaft; said shaft pivoting connection of said second drive shaft being connected to said pivoting connection of said tip of said second lever arm of said double ended lever;

a second fluid line that is coupled on one end to said control valve and connects on the other end near said shaft end of said second drive cylinder;

a fluid pressure transfer device that has a liquid chamber and air chamber; said fluid pressure transfer device configured to automatically transfer fluid pressure from one chamber to the other chamber when one chamber has a higher pressure than the other;

said liquid chamber having oil therein;

a third fluid line having oil therein that connects on one end to said liquid chamber of said fluid pressure transfer device, and connects on the other end near said closed end of said second drive cylinder; said second drive cylinder having oil therein;

a fourth fluid line that connects on one end to said air chamber of said fluid pressure transfer device, and connects on the other end to said control valve.

2. The rotary drive system of claim 1 wherein said object being rotated comprises a die holding assembly and a die.

3. The rotary drive system of claim 1, wherein said fluid pressure transfer device has a flexible diaphragm between said liquid chamber and said air chamber.

4. The rotary drive system of claim 1 wherein said double ended lever is substantially "H" shaped with said shaft being fastened to the center of said "H" shaped double ended lever.

5. A rotational drive system that is capable of rotating an object in clockwise and/or counterclockwise directions up to two hundred seventy degrees of rotation; said rotational drive system having an oil between air drive component, dual drive pistons, and an end of cycle impact cushioning device; said rotational drive system comprising:

an object that is to be rotated a double ended lever; said double ended lever having a central pivot and a first lever arm and a second lever arm; said first lever arm extending from said central pivot to a first lever arm tip; said first lever arm tip having a pivoting connection thereon; said second lever arm extending from said central pivot to a second lever arm tip; said second lever arm tip having a pivoting connection thereon;

a shaft having a first shaft end and a second shaft end; said first shaft end securely fastened to said object and said second shaft end securely fastened to said central pivot of said double ended lever;

a first drive piston and cylinder assembly having a first drive cylinder, a first drive piston and a first drive shaft; said first drive cylinder having a closed end; said closed end of said first drive cylinder having a pivoting connection thereon; said pivoting connection of said closed end of said first drive cylinder being connected to said pivoting connection of said end of said first lever arm; a flow restricting device located near said closed end of said first drive cylinder; said first drive cylinder having said first drive piston therein; said first drive shaft being connected on one end to said first drive piston; said first drive shaft having a shaft pivoting connection on the opposite end of said first drive shaft;

an end of cycle impact cushioning device that has a flow control device and an oil recovery reservoir; said flow control device having a check valve that allows unrestricted flow of fluids in a direction toward said first drive cylinder; and a flow restricting device that controls flow of fluids in a direction toward said oil recovery reservoir; said flow control device being connected to said oil recovery reservoir;

a first fluid line that is connected at one end near said shaft end of said first drive cylinder and connected at the other end to said flow control device; said fluid line having oil therein;

said first drive cylinder having oil therein;

a control valve;

a second fluid line connected at one end to said oil recovery reservoir and connected at the other end to said control valve;

a second drive piston and cylinder assembly having a second drive cylinder, a second drive piston and a second drive shaft; said second drive cylinder having a closed end; said closed end of said second drive cylinder having a pivoting connection thereon; said second drive cylinder having said second drive piston therein; said second drive shaft being connected on one end to said second drive piston; said second drive shaft having a shaft pivoting connection on the opposite end of said second drive shaft; said shaft pivoting connection of said second drive shaft being connected to said pivoting connection of said tip of said second lever arm of said double ended lever;

a third fluid line that connects on one end to said control valve and connects on the other end near said shaft end of said second drive cylinder;

a fluid pressure transfer device that has a liquid chamber and air chamber; said fluid pressure transfer device configured to automatically transfer fluid pressure from one chamber to the other chamber when one chamber has a higher pressure than the other chamber;

said liquid chamber having oil therein;

a fourth fluid line having oil therein that connects on one end to said liquid chamber of said fluid pressure transfer device, and connects on the other end near said closed end of said second drive cylinder;

said second drive cylinder having oil therein;

a fifth fluid line that connects on one end to said air chamber of said fluid pressure transfer device, and connects on the other end to said control valve.

6. The rotary drive system of claim 5, wherein said object being rotated comprises a die holding assembly and a die.

7. The rotary drive system of claim 5 wherein said fluid pressure transfer device has a flexible diaphragm between said liquid chamber and said air chamber.

8. The rotary drive system of claim 5 wherein said double ended lever is substantially "H" shaped with said shaft being fastened to the center of said "H" shaped double ended lever.

9. The rotary drive system of claim 5 wherein said oil recovery reservoir has a diffusing element therein; said defusing element configured to help retain oil in said oil recovery reservoir and allow air to escape from said oil recovery reservoir.

10. The rotary drive system of claim 5 wherein said oil recovery reservoir has a diffusing element therein; said defusing element configured to help retain oil in said oil recovery reservoir and allow air to escape from said oil recovery reservoir; said defusing element being made from copper mesh, or other metal meshes, or stacked perforated plates, or plastic beads, or fiber sponge, or combinations thereof.

11. The rotary drive system of claim 5 further including a pressure regulating device located in said fifth fluid line that connects said air chamber of said fluid transfer device to said control valve.

* * * * *